US007946738B2

(12) United States Patent
Fowler, Jr. et al.

(10) Patent No.: US 7,946,738 B2
(45) Date of Patent: May 24, 2011

(54) LIGHTING ASSEMBLY HAVING PIVOTING LENS RETAINING MEMBER

(75) Inventors: Wilton L. Fowler, Jr., Easley, SC (US); Avelino De Oliveira, Hendersonville, NC (US)

(73) Assignee: Hubbell Incorporated, Shelton, CT (US)

( * ) Notice: Subject to any disclaimer, the term of this patent is extended or adjusted under 35 U.S.C. 154(b) by 385 days.

(21) Appl. No.: 12/257,784

(22) Filed: Oct. 24, 2008

(65) Prior Publication Data

US 2010/0103686 A1 Apr. 29, 2010

(51) Int. Cl.
*F21V 21/00* (2006.01)

(52) U.S. Cl. ..... 362/374; 362/147

(58) Field of Classification Search ..... 362/147, 362/235, 237, 249.1, 374
See application file for complete search history.

(56) References Cited

U.S. PATENT DOCUMENTS

| | | | | |
|---|---|---|---|---|
| 3,210,538 | A | 10/1965 | Picha et al. | |
| 3,268,722 | A | 8/1966 | Nolan | |
| 3,943,355 | A | 3/1976 | Lundy | |
| 3,983,387 | A | 9/1976 | Van Steenhoven et al. | |
| 4,255,781 | A | 3/1981 | Plemmons et al. | |
| 5,172,976 | A * | 12/1992 | Bogdanovs | 362/374 |
| 6,210,025 | B1 | 4/2001 | Schmidt et al. | |
| 6,644,830 | B2 | 11/2003 | Lewis et al. | |
| 2001/0033487 | A1 * | 10/2001 | Crelin | 362/147 |
| 2009/0196023 | A1 * | 8/2009 | Heiking et al. | 362/147 |

FOREIGN PATENT DOCUMENTS

| | | |
|---|---|---|
| JP | 200668317 | 3/2006 |

* cited by examiner

*Primary Examiner* — David V Bruce
(74) *Attorney, Agent, or Firm* — Garrett V. Davis; Mark S. Bicks; Alfred N. Goodman

(57) ABSTRACT

A lighting assembly is provided having a main housing and retaining member hinged to the main housing. The housing has an open end with a channel for receiving and supporting a lens, diffuser and/or grate. The retaining member is hinged to close the open end of the housing and prevent removal of the lens, diffuser and grate. The retaining member is coupled to the housing by pivot pins that are received in elongated slots in the side of the housing. The retaining member is pulled away from the housing where the pivot pins slide to an outward end of the slot and then pivot in an upward or downward direction to allow removal of the lens, diffuser and grate.

24 Claims, 7 Drawing Sheets

LIGHTING ASSEMBLY HAVING PIVOTING LENS RETAINING MEMBER

FIELD OF THE INVENTION

The present invention is directed to a lighting fixture assembly having a removable lens, diffuser and/or grate. The invention is particularly directed to a lighting fixture having a pivoting retaining member such as a door and latch mechanism to enable removal of the diffuser and grate to access the interior of the lighting fixture.

BACKGROUND OF THE INVENTION

Numerous lighting fixtures for directly illuminating areas are known in the art. A common lighting assembly used in commercial buildings includes a troffer with one or more fluorescent lamps mounted therein. The lighting fixture can have a removable grate attached to the housing to allow access to the lamps for replacement. The reflectors are generally mounted to the housing. Other forms of lighting assemblies include a hinged or removable cover assembly that support the lens and/or grate and have a reflector and a lens that cooperate with the lamp in the closed position. The lamps are positioned inside the lens and the reflector is spaced from the lens to direct the light to the selected area to be illuminated.

Lighting assemblies are constructed to provide various needs and address certain lighting problems. The lighting assembly attempts to balance the required illumination of horizontal surfaces and vertical surfaces to provide the desired light quality. Difficulties often occur in smaller areas to avoid shadows or bright spots.

The lighting assemblies can use various lamp shapes and designs. The fluorescent lamp has been used frequently for many years. The fluorescent lamps are available in various sizes depending on the size of the lighting assembly. A disadvantage of many conventional fluorescent lamps is the brightness and glare which can be objectionable when viewed directly. These lighting assemblies often include opaque shielding or lenses to cover the lamp. The lens often includes prisms to diffuse the light and soften the glare. Various efforts have been made to provide lenses and shielding to reduce the brightness and glare of the fluorescent lamp. Examples of this form of lighting assembly are found in U.S. Pat. No. 5,988,829 to Holder, U.S. Pat. No. 7,229,192 to Mayfield et al., U.S. Pat. No. 6,280,052 to White and U.S. Pat. No. 7,261,435 to Gould et al.

Another example of a light fixture is disclosed in U.S. Pat. No. 7,296,910 to Mayfield et al. This light fixture includes a housing having a mounting assembly for the light and reflectors mounted on each side of the light and attached to the housing. A lens is hooked to the reflector around the light. The lens is removable from the reflector and the housing to access the light.

U.S. Published Patent Application No. 2007/0211457 to Mayfield discloses a replacement light fixture and lens assembly. The lens assembly can have a lens that hooks onto the ends of a reflector. The lens can also be mounted as a single piece with portions being painted to form reflector areas around a transparent lens portion.

While the prior lighting assemblies have generally been successful for the intended purpose, there is a continuing need in the industry for improved lighting assemblies.

SUMMARY OF THE INVENTION

The present invention is directed to a lighting fixture assembly for mounting to a horizontal surface, such as a ceiling. More particularly, the invention is directed to a lighting fixture assembly having a pivoting lens retaining member defining a door that is hinged to the housing of the lighting fixture assembly which supports a lens, diffuser and/or grate. The door is movable to enable access to the lens so that the lens can be removed to allow replacement of the lamps or repair of the electrical components.

One aspect of the invention is to provide a light assembly having a housing for enclosing and supporting at least one lamp such as a fluorescent lamp. The housing typically has an open bottom with a lens or diffuser closing the bottom end of the housing to enclose the lamp and provide the desired lighting effect. The lens is removable from the housing through the open end to allow access to replace the lamp and the lamp components. A retaining member is provided on the housing to close the open end of the housing when the lens is in the operating position. The lens is preferably received in a channel in the housing and can slide outwardly through the open end of the housing.

Another aspect of the invention is to provide a light assembly having a housing with an open end and a retaining member pivotally coupled to the end of the housing to pivot between a closed position covering the open end and an open position to enable access to the open end of the housing. In one embodiment of the invention the open end allows the lens to be removed from the housing for replacement and for repair of electrical components and replacement of the lamp.

Still another aspect of the invention is to provide a light assembly having a housing with a retaining member pivotally coupled to an end of the housing where the retaining member is movable in a linear direction to an extended position with respect to the housing and then is pivotable with respect to the housing when in the extended position to open the end of the housing. The retaining member is restrained from pivoting when seated against the housing and closing the open end of the housing. The retaining member is pulled away from the housing in a linear direction to a position where the retaining member is able to pivot with respect to the housing without interfering with the end of the housing.

The light assembly of the invention includes a housing with an elongated slot in the opposite side walls. A retaining member defining an end door has a pair of pivot pins extending outwardly from the sides which are received in a respective slot. The retaining member is able to slide linearly from a position seated against the end of the housing to an extended position where the end wall of the retaining member is spaced from the housing. The retaining member is able to pivot downwardly and upwardly when the retaining member is in the extended position to expose the open end of the housing and the channel which supports the lens.

In one embodiment of the invention the housing has an elongated slot in the opposite side walls for receiving pivot pins on a retaining member to enable the retaining member to move between a closed seated position on the housing and an open position. The slots have a first inclined portion to urge the pivot pins and the retaining member to the closed position on the housing. The slot has a second portion which receives and holds the pivot pins in an extended position so the retaining member can pivot to an open position without interference with the housing.

These and other aspects of the invention are basically attained by providing a light assembly comprising a housing having a first side wall, an opposite second side wall and an end wall extending between the side walls. The first and second side walls and the end wall form an open end portion of the housing for receiving a lens. A retaining member is pivotally coupled to the first and second side walls and is movable between a first position where the retaining member closes the open end position and an open position where the open end position is accessible.

The various aspects of the invention are also attained by providing a light assembly comprising a housing having a first side wall, an opposite second side wall, and an open portion extending between the first and second side walls. The first and second side walls have a slot extending in a substantially longitudinal direction with respect to the side walls. A lens is received in the open portion of the housing and is supported by the side walls. A retaining member has a front portion, a first side wall and a second side wall. The first side wall and the second side wall have an inwardly extending hinge pin received in a respective slot of the first and second side walls of the housing. The retaining member is movable in a longitudinal direction with respect to the side walls of the side housing and is pivotable between a first position closing the open portion and a second position for accessing the open portion and lens.

The aspects of the invention are further attained by providing a light assembly comprising a housing having a top side, an open bottom with a lens closing the open bottom, a first side wall, second side wall and an open end portion receiving the lens. Each of the first side wall and second side wall have an elongated slot extending in a longitudinal direction with respect to the housing. A retaining member has a pivot pin received in a each of the slots. A top flange extends from a top edge of the retaining member and a bottom flange extends from a bottom edge of the retaining member. The retaining member is slidable from a first position to a second position. The retaining member covers the open end portion of the housing and the top flange engages a bottom portion of the housing when in the first position and where the retaining member is spaced linearly from the housing in the second position. The retaining member is pivotable in the second position in a downward direction to expose the open end portion and lens.

These and other aspects of the invention will become apparent from the following detailed description of the invention which, in conjunction with the annexed drawings, disclose various embodiments of the invention.

BRIEF DESCRIPTION OF THE DRAWINGS

Referring to the drawings, which form a part of this original disclosure, in which.

DETAILED DESCRIPTION OF THE INVENTION

Figure 1:
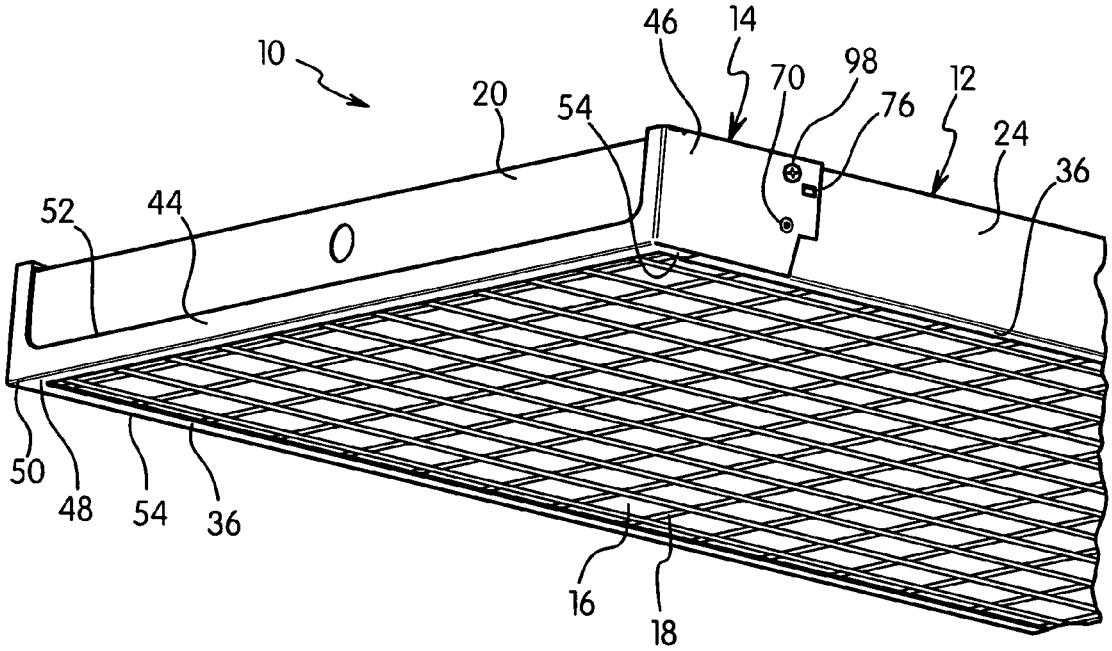
FIG. 1 is a perspective view of the light assembly in a first embodiment of the invention.

The present invention is directed to a lighting assembly. The invention is particularly directed to a lighting assembly that is constructed so that the lens or diffuser can be easily removed for accessing the interior portion of the lighting assembly for replacement of lamps and repair of the electrical components.

Referring to the drawings, the lighting assembly 10 of the invention includes a housing 12 having a retaining member shown as door 14. In one embodiment of the invention, the housing 12 includes a lens 16 and a grate 18 to protect the lens from impact and damage. The retaining member has a structure to close and at least partially cover the end of housing 12. In the embodiments illustrated and the following description, the retaining member is referred to as a door, although other structures capable of retaining the lens in the housing can be used.

Housing 12 is constructed to enclose a light source such as a lamp and to support lens 16. Lens 16 can be a standard diffuser as known in the art. A diffuser can also be used in place of the lens. Grate 18 is shown in the embodiments to protect the lens. Grate 18 in other embodiments is optional.

Figure 2:
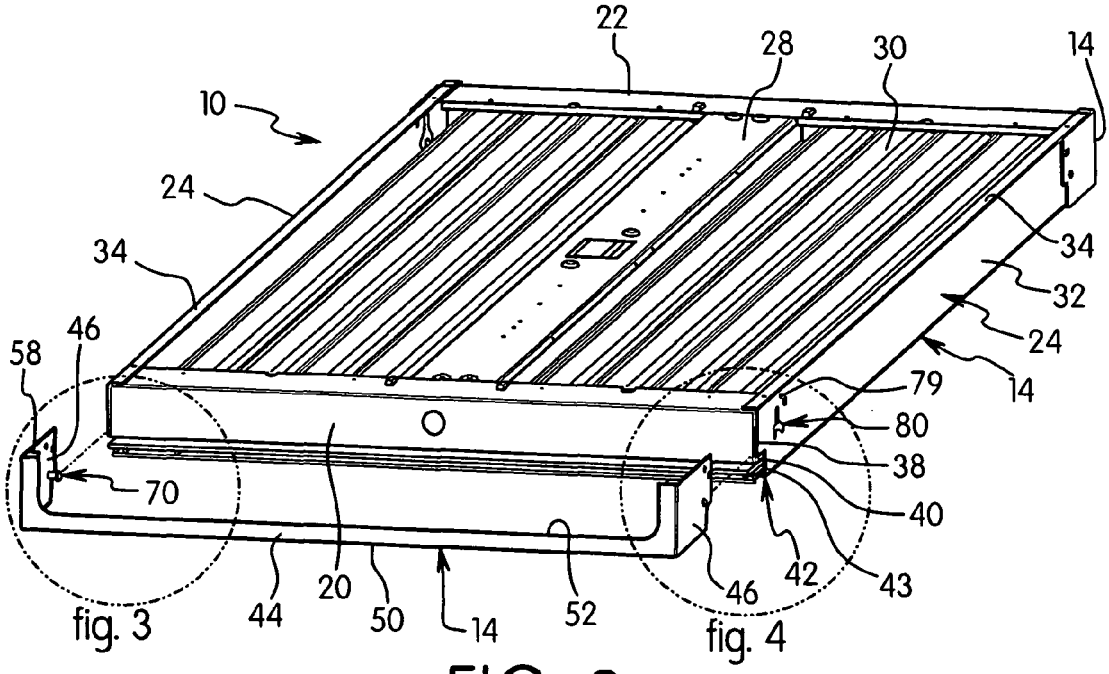
FIG. 2 is an exploded perspective view of the light assembly of FIG. 1.

In one embodiment of the invention, housing 12 is constructed to enclose a plurality of fluorescent lamps and electrical components for operating the lamps. Referring to FIGS. 1 and 2, housing 12 includes end walls 20 and 22 and opposite side walls 24. Housing 12 includes a channel 28 for enclosing a ballast and other electrical components. Channel 28 is made of sheet metal and attached to end walls 20 and 22 by fasteners or welding. Reflectors 30 are provided along a top end of housing 12 for reflecting light in a downward direction. The lamps (not shown) are positioned below the reflectors. End walls 20 and 22 preferably support lamp sockets and lamps for providing the light source. Housing 12 has an open bottom side that is covered by the lens 16 and grate 18 as shown in FIG. 1.

Figure 6:
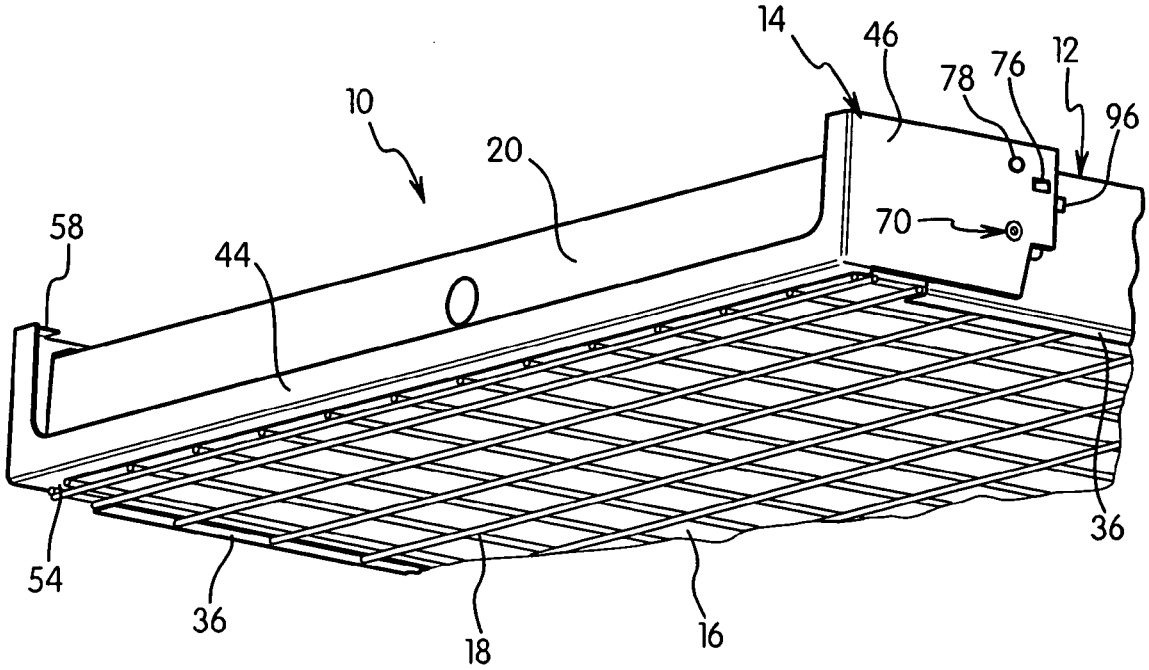
FIG. 6 is a bottom perspective view of the light assembly showing the retaining member in the extended position.
Figure 7:
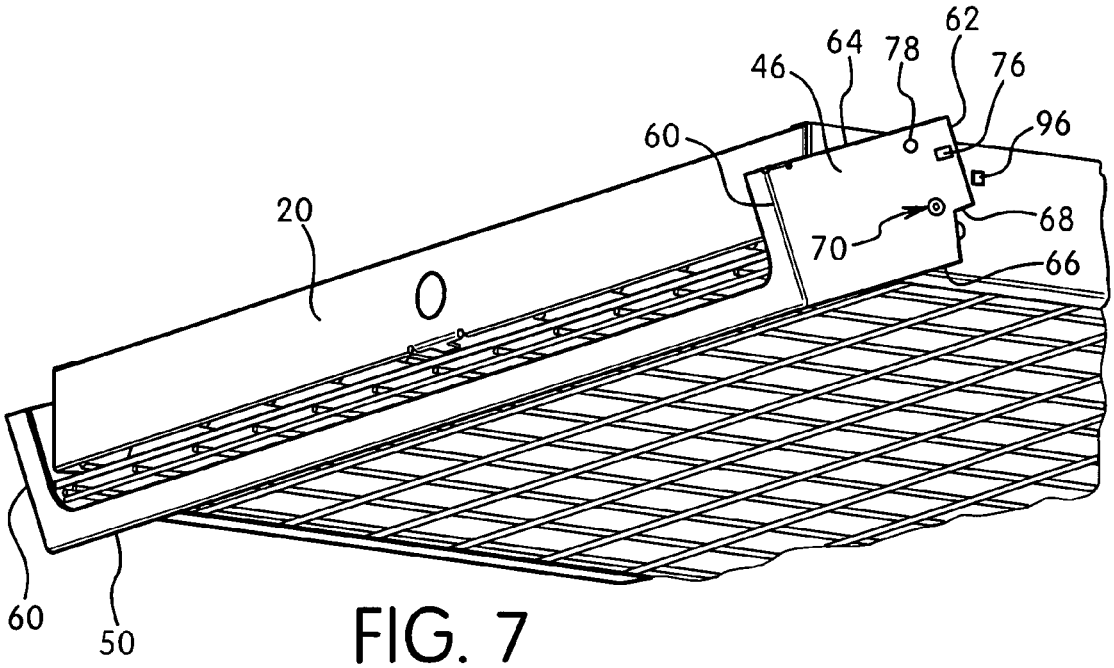
FIG. 7 is a bottom perspective view of the light assembly showing the retaining member in the partially pivoted position.

Side walls 24 in the embodiment illustrated are coupled to end walls 20 and 22 to form housing 12. Side walls 24 as shown in FIG. 2, have a side wall portion 32, a top flange 34 and a bottom flange 36 as shown in FIG. 6. Top flange 34 overlies the top edge of end walls 20 and 22 and is attached thereto by rivets, welding or other suitable fastening means.

Figure 4:
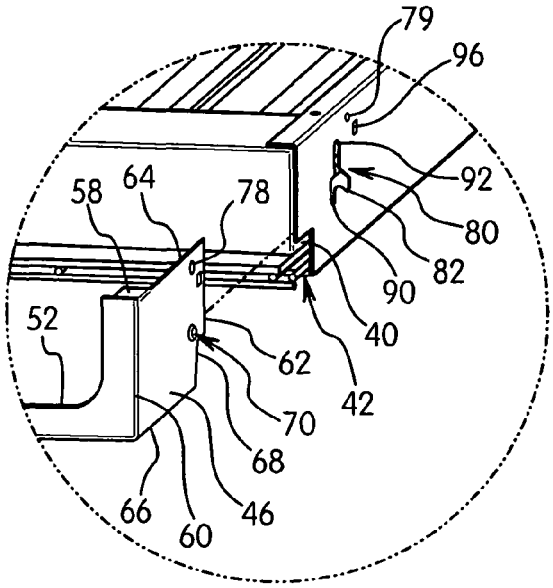
FIG. 4 is an enlarged partial perspective view of the end of the retaining member as shown as section 4 of FIG. 2.

Bottom flange 36 extends inwardly from side portion 32 in a direction substantially perpendicular to the plane of side portion 32. As shown in FIG. 4, the longitudinal end 38 of side wall 24 is formed with a notched portion 40 adjacent bottom flange 36. Bottom flange 36 extends to the edge of notched portion 40.

Side walls 24 have a height slightly greater than the height of end walls 20 and 22 such that side walls 24 extend below a bottom edge of end walls 20 and 22. Bottom flange 36 of side walls 24 is spaced below the bottom edge of end walls 20 and 22 to form an open area 42 along the bottom edge of housing 12. Bottom flange 36 of side walls 24 define a channel or slot 43 for receiving lens 16 and grate 18. Lens 16 and grate 18 can slide through open area 42 along the channel 43 formed by bottom flange 36 to cover the open bottom side of housing 12, as shown in FIGS. 1 and 4.

Door 14 is pivotally connected to housing 12 to enclose the open area 42 and the lens 16 and grate 18. Door 14 has a front wall 44 and opposite side walls 46. A bottom flange 48 extends inwardly from the bottom edge 50 of front wall 44. As shown in FIG. 2, front wall 44 has an open recessed area 52. Front wall 44 has a dimension corresponding substantially to the dimension of end wall 20 and the end of housing 12 such that front wall 44 substantially covers open area 42 when door 14 is in the closed position as shown in FIG. 1.

Figure 3:
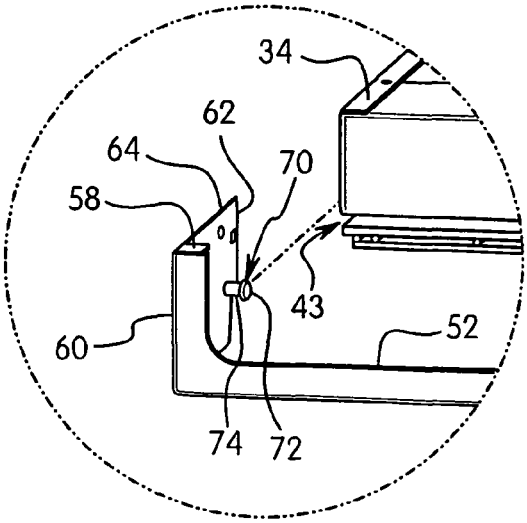
FIG. 3 is an enlarged partial perspective view of the end of the retaining member shown as section 3 of FIG. 2.
Figure 5:
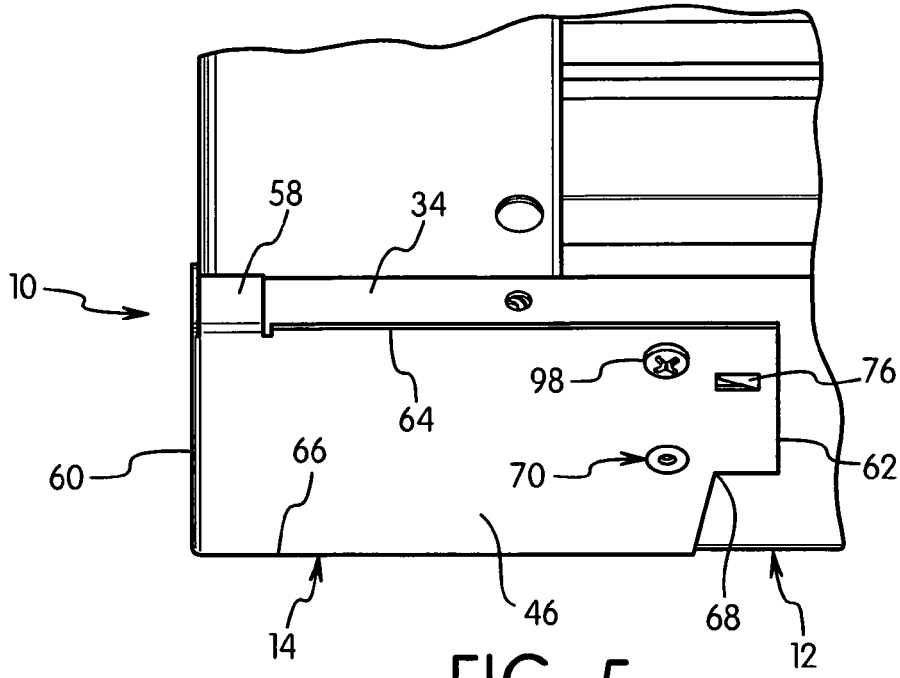
FIG. 5 is a partial perspective view of the light assembly of FIG. 1 showing the top side of the assembly.
Figure 8:
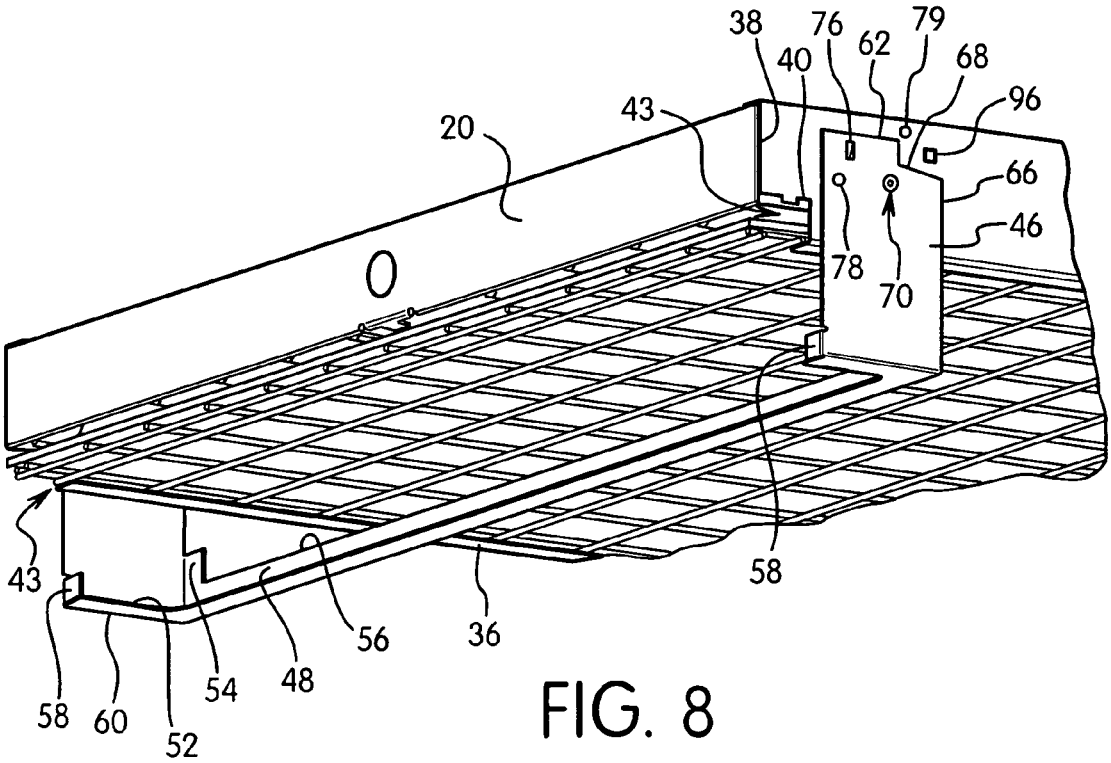
FIG. 8 is a bottom perspective view of the light assembly showing the retaining member in the open position.

Bottom flange 48 of door 14 extends the length of door 14 and has a dimension to cover the bottom edge of end wall 20. In the embodiment illustrated, bottom flange 48 includes tabs 54 adjacent each side wall 46 that extend away from front wall 44. In the embodiment illustrated, tabs 54 are integrally formed with bottom flange 48 and lie in the plane of bottom flange 48 to form a recessed area 56 between tabs 54 as shown in FIG. 8. Tabs 54 preferably have a length equal to the length of notched portion 40 and align with bottom flange 36 of housing 12 when door 14 is in the closed position as shown in FIGS. 1 and 5. A top flange 58 is provided adjacent side walls 46 and front wall 44 as shown in FIGS. 3, 5 and 8. Top flange 58 is preferably integrally formed with the respective side wall 46 and extends substantially perpendicular to the plane of side wall 46. As shown in FIG. 5, top flange 58 has a width corresponding substantially to the width of top flange 34 of side wall 24 of housing 12 and has a length to overlie top flange 34 when door 14 is in the closed position. Top flange 58 of door 14 preferably overlies top flange 34 to assist in holding door 14 in the closed position and prevent door 14 from pivoting downward.

Door 14 has a height defined by side walls 46 substantially equal to the height of side walls 24 of housing 12. Side walls 46 have a front edge 60 and a rear edge 62, a top edge 64 and bottom edge 66. Rear edge 62 is formed with a notched portion 68.

Referring to FIG. 5, side walls 46 of door 14 include an aperture receiving a pivot pin 70. Pivot pin 70 is typically riveted to side wall 46 and extends inwardly from side wall 46 towards housing 12. As shown in FIG. 3, pivot pin 70 has an enlarged head 72 and a cylindrical shank 74. A locking tab 76 extends inwardly from the side walls of door 14. In the embodiment shown, tab 76 is cut from side wall 46 and bent inwardly, as shown in FIG. 5. Side wall 46 is also formed with an aperture for receiving a fastener such as a screw 78. Locking tab 76 defines a detent for engaging a complementary recess in housing 12.

Figure 9:
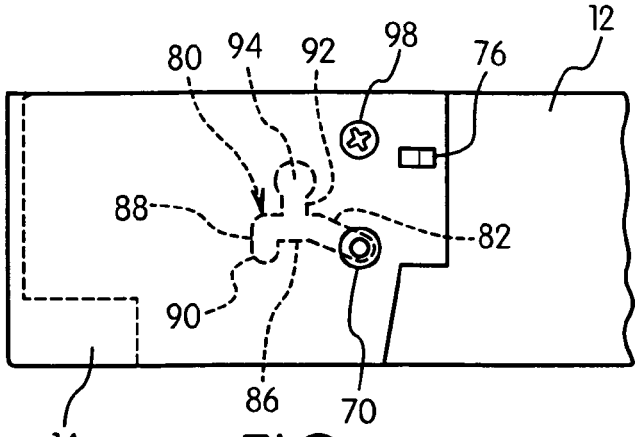
FIG. 9 is a side view of the light assembly showing the retaining member in the closed position.

Referring to FIG. 4, side wall 24 of housing 12 includes an elongated slot 80 for receiving pivot pin 70. Elongated slot 80 has a longitudinal dimension extending substantially parallel to the longitudinal dimension of side wall 24 and perpendicular to end walls 20 and 22. Elongated slot 80 has a first inclined portion 82 having an end 84 extending in a generally downward direction toward bottom flange 36 of side wall 24 away from the front edge of side wall 24. In the embodiment shown in FIGS. 1-11, slot 80 has a horizontal section 86 at the upper end of first inclined portion 82. At the forward end 88 of horizontal portion 86 is a downwardly extending portion 90. Slot 80 includes an upwardly extending portion 92 extending from horizontal portion 86. As shown in FIG. 9, upwardly extending portion 92 has a generally keyhole shape with an enlarged open area 94. The open area 94 has a dimension corresponding to the dimension of enlarged head 72 of pivot pin 70 to enable head 72 to pass through. Enlarged head 72 of pivot pin 70 is inserted through open area 94 during assembly to couple door 14 to housing 12. Slot 80 preferably has a width less than the diameter of head 72 of pivot pin 70 to retain pivot pin 70 coupled to housing 12 while allowing pivot pin 70 to slide within slot 80. Side wall 24 of housing 12 also includes a hole 96 for receiving locking tab 76 when door 14 is in the closed position shown in FIG. 9.

Lighting assembly 10 is constructed for mounting to a ceiling or other horizontal support structure. Standard wiring and electrical components are connected to lighting assembly 10 to supply power to the lamps for illuminating the designated area. The lamps are mounted within the housing 12 to the lamp sockets in a conventional manner. Once the lamps are properly installed, the lens 16 and the grate 18 are inserted through the channel 43 at the bottom side of housing 12 formed by the bottom flange 36 and the bottom side of end walls 20 and 22. Door 14 is coupled to housing 12 by expanding side walls 46 of door 14 slightly outwardly and inserting head 72 of pivot pin 70 in the respective slot 80 through the open area 94 of keyhole shaped portion 92. Preferably, side walls 46 of door 14 spring back to the original position so that the side walls overlie the side walls 24 of housing 12. Door 14 is fitted against the end walls 20 and 22 of housing 12 to close the open area 42 and to cover the ends of lens 16 and grate 18. Door 14 is seated against the end of housing 12 where top flange 34 lies against the top edge of side walls 24 and bottom flange 36 lies against the bottom side of side walls 24. Slot 80 and the inclined portion 82 of slot 80 is angled so that pivot pin 70 is assisted by gravity toward the end of inclined portion 82, as shown in FIG. 9. In the embodiment illustrated, a locking screw 98 is inserted through screw hole 78 and an aperture 79 in side walls 24 for securing door 14 to housing 12.

As shown in FIG. 2, housing 12 is formed with a door 14 at each end. Alternatively, housing 12 can have one end with a fixed end wall and a single door attached at the opposite end. When it is necessary to replace the lamps or service the electrical components within the housing, door 14 is moved from the closed position, shown in FIG. 5, to the open position, shown in FIG. 11, to enable lens 16 and grate 18 to be removed thereby providing access to the interior of housing 12.

Figure 10:
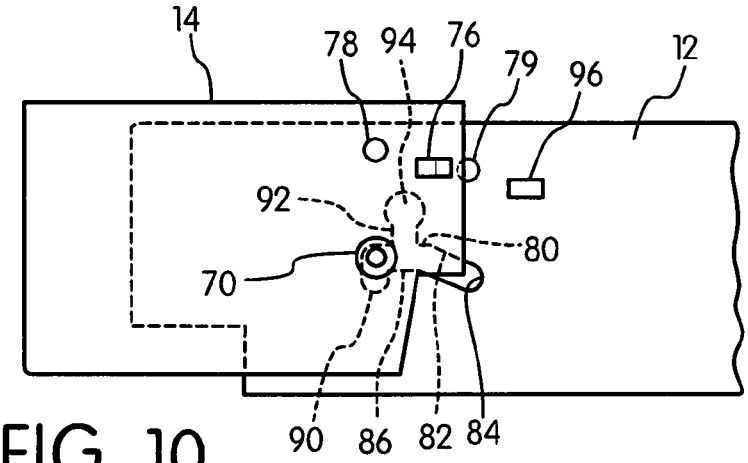
FIG. 10 is side view of the light assembly showing the retaining member in the extended position.
Figure 11:
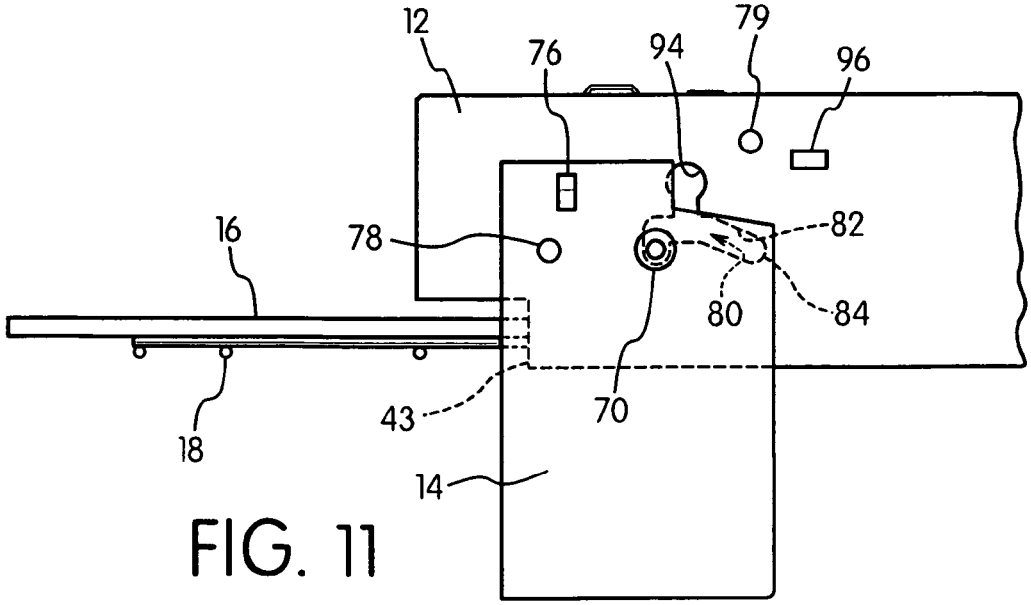
FIG. 11 is a side view of the light assembly showing the retaining member in the open position and the lens and grate partially removed from the housing.

To enable removal of lens 16 and grate 18, locking screw 98 is removed from door 14 and housing 12. Locking tabs 76 are normally received in the respective hole 76 of side wall 24 of housing 12 to retain door 14 in the closed position. Side walls 46 of door 14 are sufficiently flexible so that side walls 46 are manually pulled outwardly a slight distance to release locking tabs 76 from hole 96. Door 14 is then pulled away from housing 12 in a substantially linear fashion so that pivot pin 70 slides along slot 80 to the position shown in FIG. 10. The first inclined portion 82 of slot 80 enables door 14 to slide in a generally upward angled direction, as shown in FIG. 10, to separate top flange 58 of door 14 from top flange 34 of housing 12. Door 14 can then be pivoted in either an upward direction or in a downward direction, as shown in FIG. 11, to expose the open area 42 of the channel 43 supporting the lens 16 and grate 18. Pivot pin 70 then slides by gravity downwardly into the downwardly extending portion of slot 80, as shown in FIG. 11. The downward portion 90 of slot 80 holds door 14 to resist longitudinal movement within slot 80. Lens 16 and grate 18 can then slide outwardly from the channel 43, as shown in FIG. 11, to access the lamps and electrical components within housing 12.

After servicing light assembly 10, lens 16 and grate 18 are reinserted into the channel 43 and slid into position closing the bottom side of housing 12. Door 14 is then pivoted in a generally upward direction to the position shown in FIG. 10 and then pushed longitudinally toward housing 12 to close the open area of the channel supporting the lens and grate and to snap locking tabs 76 into the corresponding hole 96. If desired, locking screw 98 or other fastener can be inserted through the hole 78 for securing door 14 to housing 12.

Figure 12:
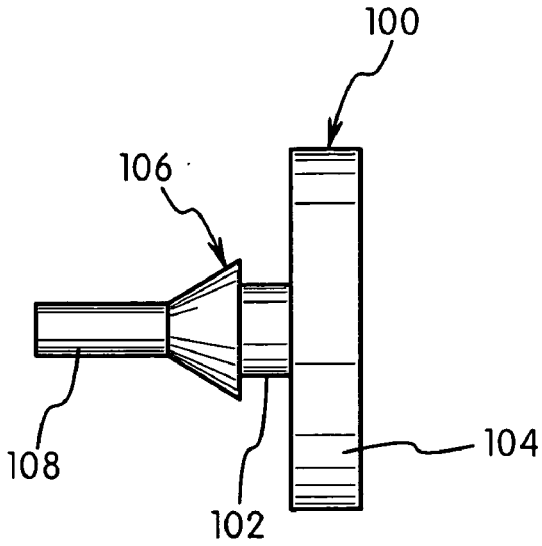
FIG. 12 is top view of the grommet in one embodiment of the invention.
Figure 13:
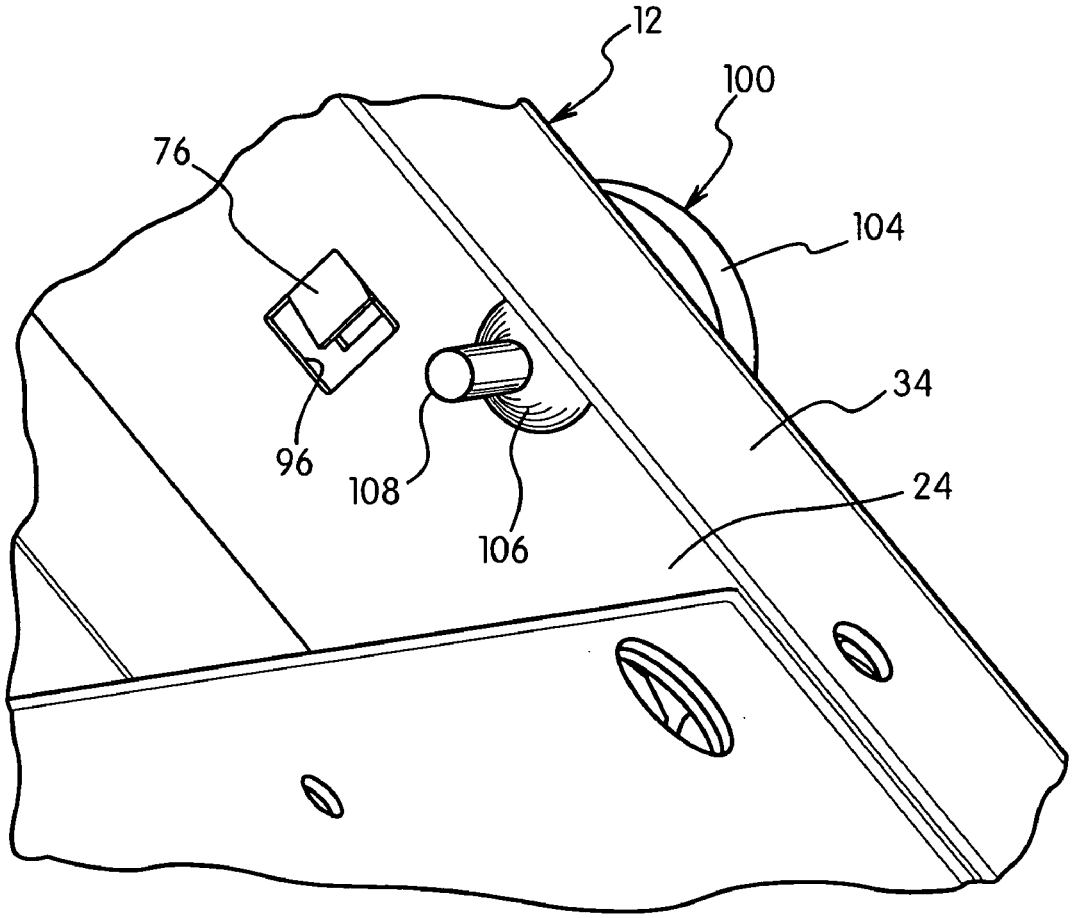
FIG. 13 is a top perspective view of the light assembly showing the grommet inserted through a hole in the housing and retaining member of the light assembly.

In the embodiment of FIGS. 1-11, a screw 98 is inserted through the hole 78 in door 14 for securing the door to housing 12. In an alternative embodiment, a grommet 100 shown in FIG. 12 can be inserted through the hole 78 to hold door 14 closed and prevent door 14 from pivoting open. Grommet 100 is preferably made of a flexible rubber material and includes a shaft 102 with an enlarged head 104 at one end and a frustoconical shaped stop member 106 spaced from head 104. A guide stem 108 extends from stop member 106. As shown in FIG. 13, grommet 100 is inserted through the holes in the door 14 and housing 12 to retain door 14 in the closed position. Grommet 100 can be removed by pulling outwardly and separating stop member 106 from door 14. Door 14 can then be pivoted to the open position as in the previous embodiment.

In the embodiments of the invention, the slots of the side wall of the housing is oriented to retain the door in the closed position during normal use of the lighting assembly 10. The slot allows movement of the door by manually pulling outwardly from the housing which causes the door to slide in a generally upward direction a distance sufficient to enable the door to clear the front end of the housing when pivoted thereby allowing the door to pivot to an open position for accessing the channel for removing the lens and grate. The slot preferably has a longitudinal length sufficient to enable the door to slide outwardly to a position where the door can pivot without interfering with the housing. The inclined portion 82 of slot 80 forms a cam surface with the pivot pin 70 to provide upward sliding movement as door 14 is pulled away from housing 12. The inclined portions of the slot define a latch mechanism or stop member for retaining the door in the closed position seated against the front wall of the housing.

The slot for receiving the pivot pins of the door can have various shapes and dimensions depending on the shape and size of the door. In an alternative embodiment shown in FIGS. 14-16, lighting assembly 110 includes a housing 112 and door 114. Door 114 is substantially the same as door 14 in the embodiment of FIGS. 1-11. Housing 112 is substantially the same as housing 12 with the exception of the elongated slot 116. Therefore, identical components are identified by the same reference number with the additional of a prime.

Figure 14:
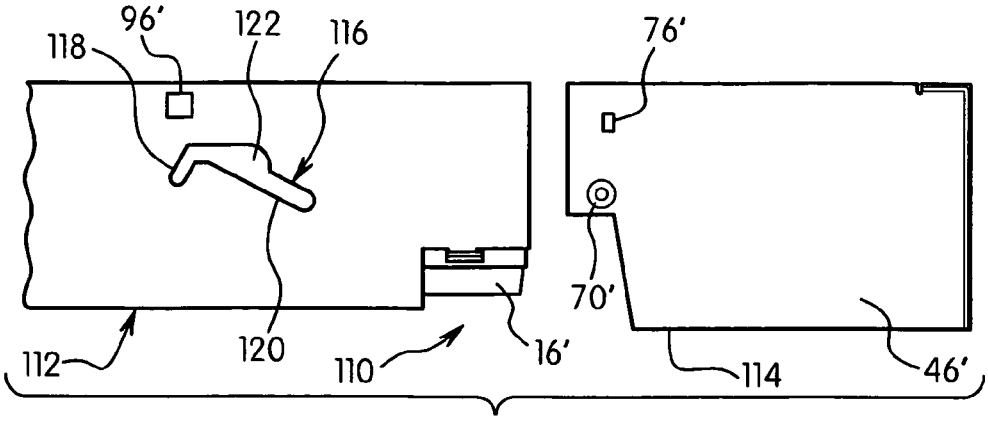
FIG. 14 is an exploded side view of the light assembly in an alternative embodiment of the invention.
Figure 15:
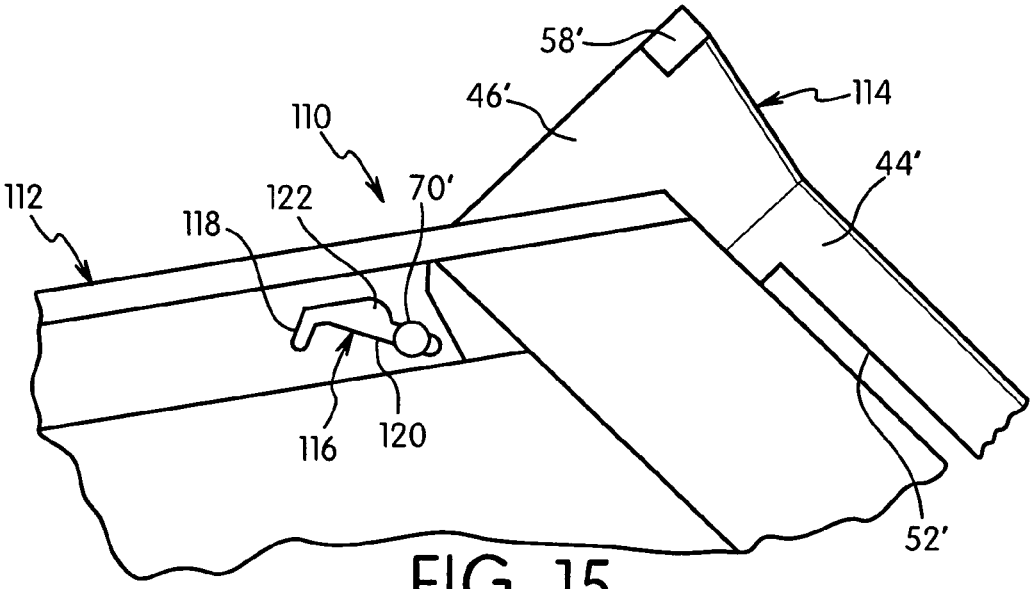
FIG. 15 is a partial top perspective view of the housing of FIG. 14 showing the retaining member in a partially open position.
Figure 16:
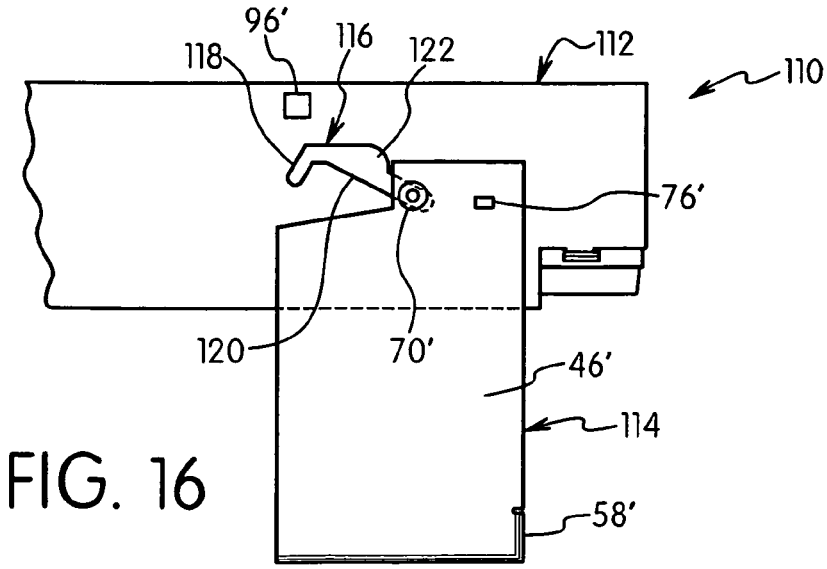
FIG. 16 is a side view of the light assembly of FIG. 14 showing the retaining member in the open position.

Slot 116 as shown in FIG. 14, has an inclined first portion 118 which extends at an inclined angle in a generally upward direction toward the front end of housing 112. As in the previous embodiment, the inclined first portion 118 receives the pivot pin 70' and retains pivot pin 70' and door 114 seated against housing 112 when door 114 is in the closed position. Slot 116 includes a second inclined portion 120 extending in a generally downward direction toward the front end of housing 112 for enabling door 114 to slide outwardly from housing 112 to the position shown in FIGS. 15 and 16. Door 114 when pulled outwardly from housing 112 enables door 114 to pivot in an upward direction as shown in FIG. 15 and a downward direction as shown in FIG. 16 without interfering with the front end of housing 112. In this embodiment, the second inclined portion 120 has an enlarged upper portion 122 to allow the head of pivot 70' to be inserted into slot 116 during assembly.

While various embodiments have been chosen to illustrate the invention, it will be understood by those skilled in the art that various changes and modifications can be made without departing from the scope of the invention as defined in the appended claims.

What is claimed is:

1. A light assembly comprising:

a housing having a first side wall, an opposite second side wall and an end wall extending between the side walls, said first and second side walls and said end wall forming an open end portion of said housing for receiving a lens; and a retaining member pivotally coupled to said first and second side walls and being movable between a first position where said retaining member closes said open end position and an open position where said open end position is accessible.

2. The light assembly of claim 1, wherein said first and second side walls have an elongated slot extending in a substantially longitudinal direction with respect to said housing; and said side walls of said door each have an inwardly extending pivot pin received in a respective slot for pivotally connecting said door to said housing.

3. The light assembly of claim 2, wherein said pivot pins are slidable in a linear direction in the respective slot whereby said retaining member is movable in a linear direction with respect to said housing.

4. The light assembly of claim 3, wherein each said slot has a first inclined portion and a second inclined portion, said first inclined portion extending in an upward direction toward said end portion of said housing.

5. The light assembly of claim 4, wherein said second inclined portion extends in a downward direction toward said end portion of said housing.

6. The light assembly of claim 1, wherein said retaining member includes a first side wall, a second side wall and an end wall, said retaining member having a top end with a flange extending substantially perpendicular to said end wall for overlying a top edge of said housing when said retaining member is in said closed first position.

7. The light assembly of claim 6, wherein said retaining member is movable in a substantially linear direction outwardly from said end wall of said housing to separate said flange from said housing, thereby enabling said retaining member to pivot to said open second position.

8. The light assembly of claim 1, wherein said retaining member includes a coupling member for engaging said housing to hold said retaining member in the closed position.

9. The light assembly of claim 8, wherein said coupling member comprises a detent extending inwardly from at least one of said side walls of said retaining member and where at least one of said side walls of said housing has a recess for receiving said detent.

10. A light assembly comprising:

a housing having a first side wall, an opposite second side wall, and an open portion extending between said first and second side walls, said first and second side walls having a slot extending in a substantially longitudinal direction with respect to said side walls;

a lens received in said open portion of said housing and being supported by said side walls;

a retaining member having a front portion, a first side wall and a second side wall, said first side wall and said second side wall having an inwardly extending hinge pin received in a respective slot of said first and second side walls of said housing, said retaining member being movable in a longitudinal direction with respect to said side walls of said housing, and being pivotable between a first position closing said open portion and a second position for accessing said open portion and lens.

11. The light assembly of claim 10, wherein said slot has a first inclined portion and a second inclined portion, said first inclined portion extending in a substantially upward direction toward an end of said housing.

12. The light assembly of claim 11, wherein said first inclined portion of said slot is oriented with respect to said retaining member and the respective hinge pin, whereby when the respective hinge pin is received in the first inclined portion, said retaining member is retained in the closed position and restrained from pivotal movement.

13. The light assembly of claim 12, wherein said retaining member is pivotable when said hinge pin is in said second inclined portion of said slot.

14. The light assembly of claim 13, wherein said second inclined portion of said slot extends in a substantially downward direction toward said open portion of said housing.

15. The light assembly of claim 10, wherein said retaining member includes a first side wall, a second side wall, an end wall, a top end, and a flange extending from said top end substantially perpendicular to said end wall, for overlying a top edge of said housing when said retaining member is in the closed first position.

16. The light assembly of claim 15, wherein said flange separates from said housing when said retaining member is moved linearly away from the said housing, thereby enabling said retaining member to pivot to the open second position.

17. The light assembly of claim 10, wherein said retaining member includes a coupling member for engaging said housing to hold said retaining member in the closed position.

18. The light assembly of claim 17, wherein said coupling member comprises a detent extending inwardly from at least one of said side walls of said retaining member on side walls of said housing, and where at least one of said side walls of said housing or side walls of said retaining member has a recess for receiving said detent.

19. A light assembly comprising:

a housing having a top side, an open bottom with a lens closing the open bottom, a first side wall, second side wall and an open end portion receiving said lens, each said first side wall and second side wall having an elongated slot extending in a longitudinal direction with respect to said housing; and a retaining member having a pivot pin received in a each of said slots, a top flange extending from a top edge of said retaining member and a bottom flange extending from a bottom edge of said retaining member, said retaining member being slidable from a first position to a second position, said retaining member covering said open end portion of said housing and said top flange engaging a bottom portion of said housing when in said first position and where said retaining member is spaced linearly from said housing in said second position, and said retaining member being pivotable in said second position in a downward direction to expose said open end portion and lens.

20. The light assembly of claim 19, wherein said slot in said first and second side walls have a first inclined portion wherein said pivot pin of said retaining member slides in said first inclined portion in a substantially upward direction by sliding said retaining member outwardly from said housing to separate said upper flange from said housing.

21. The light assembly of claim 20, wherein said first inclined portion of said slot has a distal end with a downwardly extending second portion, and where said retaining member is pivotable when said pivot pin is at said distal end.

22. The light assembly of claim 21, wherein said retaining member includes a coupling member for holding said retaining member in the closed position.

23. The light assembly of claim 22, wherein said coupling member comprises a detent extending from said retaining member and being received in a recess in one of said first and second side walls of said housing.

24. The light assembly of claim 19, wherein said retaining member has a first side wall and a second side wall and where one of said pivot pins extends inwardly from each of said side walls.

* * * * *